United States Patent [19]

Good et al.

[11] 4,319,971

[45] Mar. 16, 1982

[54] METHOD AND MEANS FOR RECOVERING SILVER BY ELECTROLYSIS

[75] Inventors: Dallis L. Good, Middlesboro, Ky.; David L. Good, Des Moines, Iowa

[73] Assignee: Metal Extraction Processes Corporation, Des Moines, Iowa

[21] Appl. No.: 247,722

[22] Filed: Mar. 26, 1981

[51] Int. Cl.[3] ..... C25C 1/22; C25C 7/00

[52] U.S. Cl. ..... 204/109; 204/257; 204/260; 204/261; 204/263; 204/269; 204/271; 204/272; 204/273; 204/275

[58] Field of Search ..... 204/109, 245, 257, 260–261, 204/263, 269, 271–273, 275

[56] References Cited

U.S. PATENT DOCUMENTS 3,583,897 6/1971 Fulweiler ..... 204/109

3,694,341 9/1972 Luck ..... 204/109

4,054,503 10/1977 Higgins ..... 204/271

*Primary Examiner*—R. L. Andrews

*Attorney, Agent, or Firm*—Zarley, McKee, Thomte, Voorhees & Sease

[57] ABSTRACT

The electrolysis device of the present invention comprises an elongated vertically disposed hollow housing having an upper end and an open lower end. The housing has at least one inlet opening spaced above the open lower end. An anode is placed within the hollow housing, and a cathode plate is detachably mounted to the lower end of the housing. An electrically operated impeller is mounted between the inlet opening and the open lower end of the housing, and it draws fluid within the inlet opening and drives it outwardly through the open lower end of the housing. The silver ions collect on the negatively charged cathode plate.

8 Claims, 5 Drawing Figures

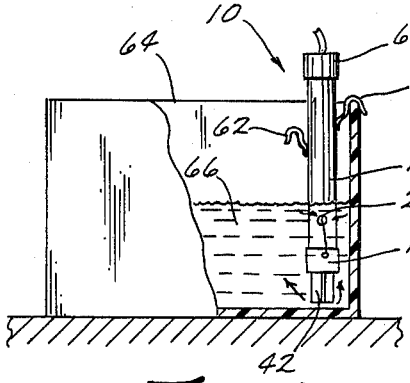
Fig. 1
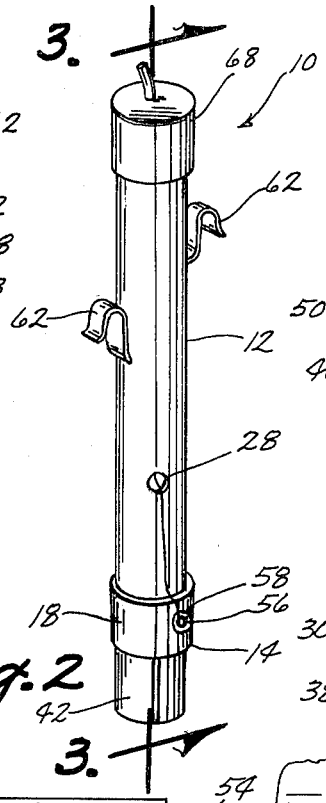
Fig. 2
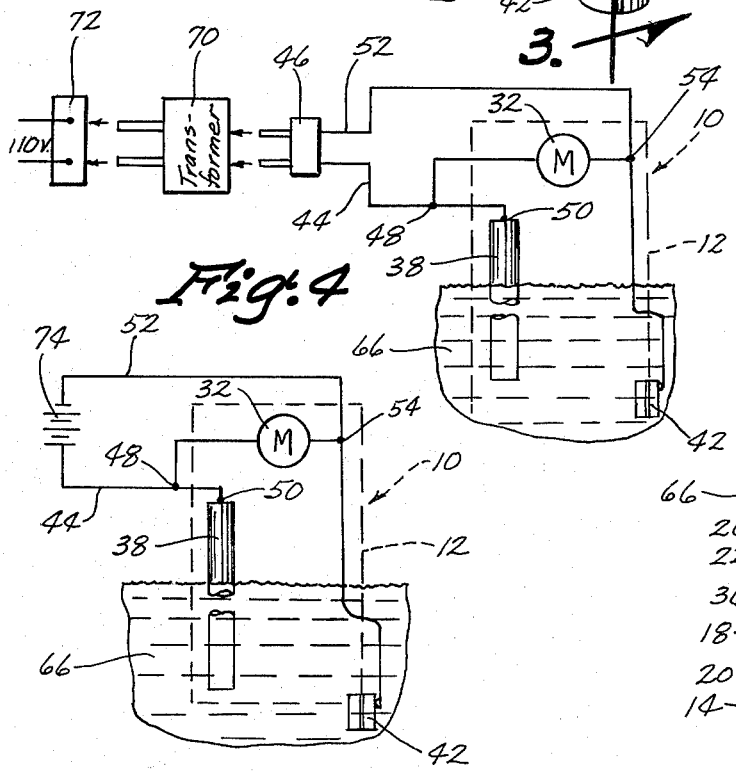
Fig. 4
Fig. 5
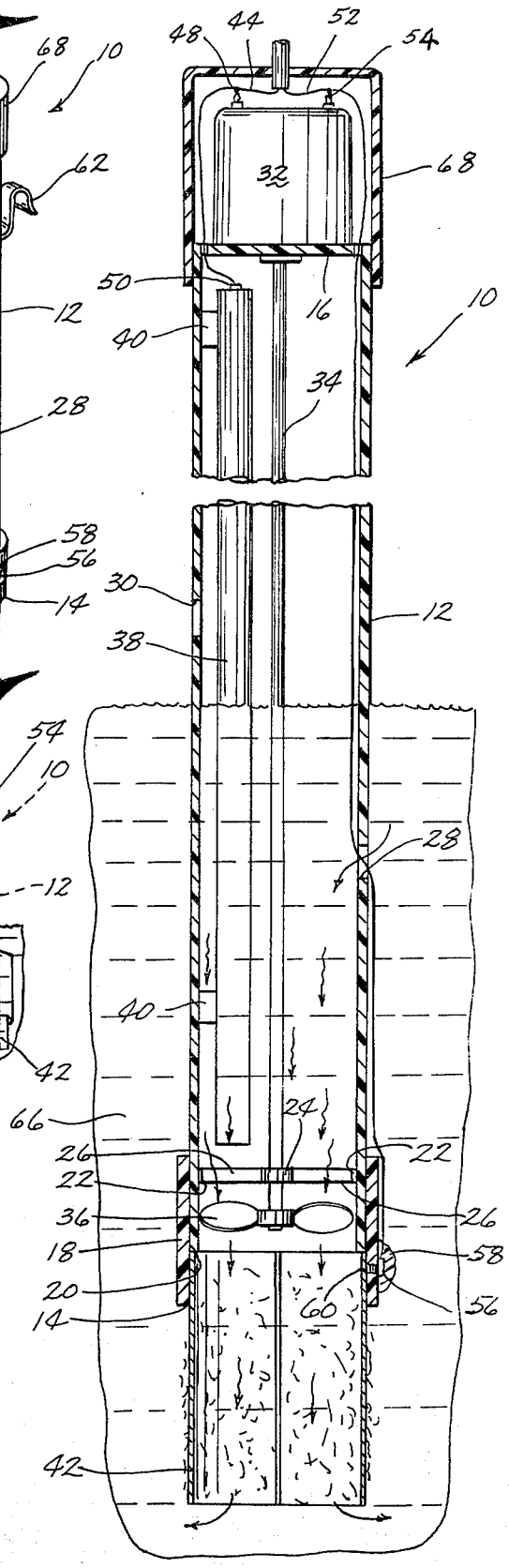
Fig. 3

METHOD AND MEANS FOR RECOVERING SILVER BY ELECTROLYSIS

BACKROUND OF THE INVENTION

This invention relates to an electrolysis device and method for recovering silver.

Most types of photographic film utilize silver bromide as the light sensitive compound which is responsible for the production of pictures. The silver bromide, a cream white solid, is dispersed in gelatin and the mixture is spread on the cellulose or film. In some cases, silver chloride or silver iodide may be used for special purpose films. After the film has been exposed, it is placed in a developing bath such as hydroquinone or some other reducing agent to reduce the silver bromide to pure silver. The ever-increasing price of silver has made it desirable to recover this silver from photographic film in metal form so that it may be sold. Silver may be collected from negative film, printed film, x-ray film or any other film which utilizes a silver base for its developing process.

Accordingly, a primary object of the present invention is the provision of an improved portable electrolysis unit and method for recovering silver from photographic film.

A further object of the present invention is the provision of a device which may be used by amateur or professional photographers, and which is inexpensive and simple to use.

A further object of the present invention is the provision of a device which permits the recovery of silver having a purity as high as 97%.

A further object of the present invention is the provision of a device and method which may be operated either on alternating current or on direct current.

A further object of the present invention is the provision of a device for recovering silver which may be utilized in a conventional container of fluid, having silver ions therein.

A further object of the present invention is the provision of a device which is economical to manufacture, durable in use and safe in operation.

SUMMARY OF THE INVENTION

The present invention utilizes an elongated, hollow housing, having an open lower end and having an inlet opening in its cylindrical walls at a point spaced above the open lower end. An impeller is placed between the inlet opening and the open lower end and is adapted to draw the fluid into the inlet opening and expel the fluid outwardly through the outlet opening. A cathode plate is positioned adjacent the outlet opening and an anode is placed within the cylindrical housing. Because of the negative charge on the cathode plate, the silver ions are attracted to the cathode plate and the silver metal collects on the plate. After the plate has been coated, it is removed and flexed and the silver flakes off of the cathode.

The device is compact and can be hooked over the side of any conventional container having the fluid containing the silver ions therein. The device operates off of DC, and can be either battery operated or can utilize a transformer which can be plugged into a conventional 110 volt outlet.

BRIEF DESCRIPTION OF FIGURES OF THE DRAWINGS

FIG. 1 is an elevational view, partially cut away, showing the present invention immersed in a fluid of liquid having silver ions therein.

FIG. 2 is a perspective view of the device of the present invention.

FIG. 3 is a sectional view taken along line 3—3 of FIG. 2.

FIG. 4 is a schematic view of the device for use with a transformer which can be plugged into 110 volt, 60 cycle outlet.

FIG. 5 is a schematic view of the device utilized with a battery or other DC source.

DETAILED DESCRIPTION OF THE INVENTION

Referring to the drawings, the numeral 10 generally designates the electrolysis device of the present invention. Device 10 comprises an elongated cylindrical housing 12, having an open lower end 14, and having an upper end wall 16 at its upper end. An annular rim 18 is positioned adjacent the lower end of housing 12 and forms a downwardly presented shoulder 20 which is spaced upwardly a short distance from the lower open end 14. Positioned slightly above shoulder 20 is a web 22 which supports a bearing 24 located adjacent the longitudinal axis of housing 12. Web 22 includes flow openings 26 which permit fluid to flow past web 22 toward lower open end 14.

A pair of wall openings 28, 30 are provided in housing 12 and are axially offset from one another. In the position shown in FIG. 3, opening 30 functions as a vent hole whereas opening 28 functions as a fluid inlet opening.

Mounted above upper end wall 16 is a DC motor 32 having a shaft 34 extending through wall 16 and also through bearing 24. An impeller blade 36 is mounted to the lower end of shaft 34 below bearing 24. Wall 16 seals motor 32 from any fluid which might be splashed upwardly from below wall 16.

Operation of motor 32 causes rotation of shaft 34 and rotation of impeller blade 36.

A carbon anode 38 is mounted to the interior of housing 12 by means of a bracket 40. Anode 38 extends downwardly to a point below the lowest wall opening 28.

A cathode plate 42 is formed of a rectangular metal sheet which is rolled into cylindrical form. The resiliency of the metal plate 42 causes it to spring outwardly in a radial direction. Plate 42 is formed into the cylindrical shape and is frictionally fitted within lower end 14 as shown in FIG. 42. The outward spring action of the plate causes it to frictionally engage the interior surface of rim 18 so as to be held in place. Shoulders 20 prevent the insertion of the plate into housing 12 beyond a predetermined distance.

A positive electrical connecting wire 44 is adapted to be connected to a plug 46. Wire 44 is also connected to the positive terminal 48 of motor 32, and to the positive terminal 50 of anode 38.

A negative electrical wire 52 is connected to plug 46 and is also connected to a negative terminal 54 on motor 32. Wire 52 then extends downwardly within housing 12 until it reaches opening 28. Wire 52 extends through opening 28 to the exterior of housing 12 and downwarly adjacent lower end 14 of housing 12, where it is connected to a metal contact screw 56. An epoxy coating 58 covers the connection between wire 52 and contact 56 so as to prevent the water from creating a short circuit. Screw 56 extends through the wall of housing 12 and protrudes inwardly to a contact point 60 within housing 12. Contact point 60 is in electrical contact with cathode plate 42 when cathode plate 42 is inserted within the lower end 14 of housing 12. Thus, wire 52 delivers a negative charge to contact plate 42.

The exterior of housing 12 is provided with one or more hooks 62 which can engage the upper edge of a container 64 having a fluid 66 with silver ions therein. A cap 68 is fitted over the upper end of housing 12 so as to enclose motor 32.

In operation, plug 46 (FIG. 4) is plugged into transformer 70 which in turn is plugged into a standard 110 volt, 60 cycle outlet designated by the numeral 72. This causes actuation of motor 32 so as to rotate impeller 36. At the same time, anode 38 is given a positive charge and cathode plate 42 is given a negative charge. The rotation of impeller 36 causes fluid to be drawn into inlet opening 28 and to be forced outwardly through outlet opening 14. Cathode plate 42 forms a continuation of outlet opening 14, and therefore the fluid passes through the cylindrical surface formed by cathode plate 42. Because of the potential difference between anode 38 and cathode plate 42, the silver ions are attracted to the cathode plate 42 and the silver is deposited thereon. The fluid 66 within container 64 is continuously circulated inwardly through opening 28 and outwardly through the lower end 14 of housing 12. This insures that the entire fluid passes between the cathode and the anode so as to achieve a more full electrolysis of all the ions with container 64.

After a satisfactory amount of silver has been deposited on cathode plate 42, the cathode plate may be removed from the lower end of housing 12 and may be flexed so as to cause the silver to flake off into a collecting container.

Referring to FIG. 5, the device is shown in a circuit utilizing a battery or other direct current source disignated by the numeral 74. All other components are the same in FIG. 5.

The device of the present invention is compact and light in weight and is easily portable. It may be utilized in any container of fluid and because of the complete circulation achieved, there is a more thorough electrolysis of the silver ions which are within the fluid in the container. The device may be utilized with batteries or may be utilized with a standard alternating current outlet. Housing 12 is formed from a dielectric material, preferably plastic, and because wires 42, 52 carry direct current, they maximize the safety of the device.

Thus, it can be seen that the device accomplishes at least all of its stated objectives.

What is claimed is:

1. A method for extracting silver by electrolysis from a fluid solution having silver ions therein, said method comprising:

inserting an elongated hollow housing into said fluid;

driving impeller means within said housing so as to draw said fluid into said housing through an inlet opening located above said impeller means and so as to expel said fluid outwardly through an outlet opening below said impeller means;

placing a negatively charged cathode in the path of fluid flow caused by said impeller means whereby said silver ions will be attracted to said cathode;

placing a positive charge on an anode located within said housing in the path of fluid flow caused by said impeller means.

2. A method according to claim 1 comprising removing said cathode from said housing and flexing said cathode so as to cause the silver accumulated thereon to chip off said cathode.

3. An electrolysis device for recovering silver from a container of fluid having silver ions therein, comprising:

an elongated hollow housing having an upper end and a lower end, said lower end being open, said housing having at least one inlet opening therein spaced above said open lower end;

an anode within said hollow housing, at least a portion of said anode being positioned below said inlet opening;

cathode means detachably mounted to said lower end of said housing;

an electric motor mounted to said housing adjacent said upper end thereof;

impeller means mounted within said housing below said inlet opening and above said lower open end of said housing for drawing fluid into said housing through said inlet opening and expelling fluid outwardly through said open lower end;

mechanism drivingly interconnecting said motor to said impeller;

a positive electric connector connected to said anode; and a negative electric connector connected to said cathode.

4. A device according to claim 3 wherein said cathode comprises a metal plate.

5. A device according to claim 4 wherein said metal plate is rectangular in shape and is rolled into a cylinder and frictionally inserted within said lower end of said housing so that said cylinder provides an extension of said lower end of said housing.

6. A device according to claim 5 wherein said negative connector comprises a metal contact and a wire connected to said metal contact, said contact having a first end on the exterior of said housing and a second end extending into the interior of said housing and engaging the portion of said metal plate frictionally inserted into said lower end of said housing.

7. A device according to claim 5 wherein said metal plate is resilient and yieldably pliable to permit silver to be removed from the surface of said plate in response to manual flexing of said plate.

8. A device according to claim 3 wherein said housing comprises mounting hooks mounted on the exterior thereof for permitting said housing to hang in a vertically disposed position on the edge of said container.

* * * * *